US005457916A

United States Patent [19]

Tenute

[11] Patent Number: 5,457,916

[45] Date of Patent: Oct. 17, 1995

[54] RAIN GUTTER PROTECTION DEVICE

[76] Inventor: Steven J. Tenute, 1108 Burke Ct., Naperville, Ill. 60563

[21] Appl. No.: 155,465

[22] Filed: Nov. 19, 1993

[51] Int. Cl.[6] ..... E04D 13/06

[52] U.S. Cl. ..... 52/12; 52/11; 210/162; 210/477

[58] Field of Search ..... 52/11, 12, 13; 210/477, 162

[56] References Cited

U.S. PATENT DOCUMENTS

| | | | |
|---|---|---|---|
| 217,002 | 7/1879 | Decrow | 52/11 |
| 891,405 | 6/1908 | Cassens | 52/12 |
| 2,669,950 | 2/1954 | Bartholomew | 52/11 |
| 2,672,832 | 3/1954 | Goetz | 52/12 |
| 4,404,775 | 9/1983 | Demartini | 52/12 |
| 4,435,925 | 3/1984 | Jefferys | 52/12 |
| 4,493,588 | 1/1985 | Duffy | 52/12 X |
| 4,497,146 | 2/1985 | Demartini | 52/11 |
| 4,757,649 | 7/1988 | Vahldieck | 52/12 |
| 4,796,390 | 1/1989 | Demartini | 52/12 |
| 4,912,888 | 4/1990 | Martin | 52/12 |
| 5,010,696 | 4/1991 | Knittel | 52/11 |
| 5,016,404 | 5/1991 | Briggs | 52/12 |
| 5,072,551 | 12/1991 | Manoogian, Jr. | 52/12 |
| 5,216,851 | 6/1993 | Kuhns | 52/12 |

FOREIGN PATENT DOCUMENTS

| | | | |
|---|---|---|---|
| 3640634 | 6/1988 | Germany | 52/11 |
| 3931020 | 5/1990 | Germany | 52/11 |
| 0297478 | 1/1992 | Germany | 52/11 |
| 0221657 | 9/1991 | Japan | 52/11 |

*Primary Examiner*—Michael Safavi
*Assistant Examiner*—Winnie S. Yip
*Attorney, Agent, or Firm*—Lee, Mann, Smith, McWilliams, Sweeney & Ohlson

[57] ABSTRACT

A device for covering and protecting a rain gutter to prevent debris, vermin and other material from entering the gutter and accumulating therein. The device comprises a main body adapted to be affixed to the roof, and a rain water deflector extending from the main body downwardly into the gutter, forming a trough and extending to an edge flange which can be affixed to an outwardly-extending gutter flange. The trough has a series of slots therein to allow water to pass from the trough into the rain gutter. The trough is oriented at least partly beneath the main body so that debris will pass thereover while water will sheet down the deflector into the trough and be captured within the gutter therebeneath.

4 Claims, 1 Drawing Sheet

RAIN GUTTER PROTECTION DEVICE

BACKGROUND OF THE INVENTION

This invention relates to rain gutter protection devices, and in particular to a device for completely covering a rain gutter to prevent debris, vermin and other material from entering the gutter, while freely allowing rain water to enter.

Homes and other buildings, when having a pitched roof, typically are built with a rain gutter used to collect rain water from the roof and direct that water away from the building structure. Gutters typically are connected to one or more downspouts and the water is then channeled away from the structure as desired.

While gutters serve a useful purpose, in most environments, gutters eventually become clogged with leaves, sticks and other debris, and are inviting locations for bees, birds and other vermin. Whenever the gutter becomes fully or partially blocked, its efficiency is greatly reduced, leading to many problems, including damage to adjacent facia, misdirected water, overflow, and other similar problems.

To prevent collection of material within a gutter and to protect it, various devices have been developed in the past to partially shield gutters. Examples are found in U.S. Pat. Nos. 2,672,832; 4,404,775; 4,435,925; 4,796,390; 5,016,404 and 5,216,851. While such devices are effective, most of them do not entirely cover a gutter, and since there are typically variations in width between the outward edge of a gutter and the building facia, large gaps can occur, creating just the problems intended to be avoided. Those that do completely cover the gutter are complex caps, such as shown in U.S. Pat. No. 5,216,851, and due to variations in gutter dimension, are extremely difficult to accurately affix to an existing gutter.

Other devices have been developed to replace gutters with special structures aimed at preventing clogging. Such devices are shown in U.S. Pat. Nos. 2,669,950; 4,493,588 and 4,757,649. However, these devices, being specialized structures, are intended to actually replace gutters, and are commensurately more expensive than simply applying a protecting device to an existing gutter or a commercially available gutter.

SUMMARY OF THE INVENTION

The invention is directed to a rain gutter protecting device for use with a conventional gutter. The protecting device comprises an elongated, continuous main body which is adapted to be affixed to a roof and to extend outwardly from the roof over a rain gutter secured along one edge of the roof. An elongated, continuous rain water deflector extends from an edge region of the main body, the deflector comprising four portions. A first portion is curved downwardly and outwardly from the edge region and then recurved inwardly beneath the main body. A second portion extends from the first portion and is curved downwardly and outwardly beneath the main body, forming at least part of a trough parallel to the roof edge and adapted to capture water therein. A third portion extends from the second portion and is curved upwardly from the trough. A fourth portion extends outwardly from the third portion and comprises a continuous attachment flange. A plurality of spaced, elongated slots are formed in the trough and shaped to emit water from the trough into the rain gutter therebeneath.

In accordance with the preferred form of the invention, the second and third portions of the rain water deflector form the trough, with the trough being oriented below the first portion and at least partially beneath the main body. With the trough thus being tucked at least partially beneath the main body, debris on the roof will fall from the roof over the trough, without entering the trough, while water will sheet along the device and, due to surface tension, follow the contours of the rain water deflector into the trough.

Means is provided for affixing the flange to a rain gutter. That means preferably comprises a series of spaced apertures in the flange through which fasteners may be passed and affixed to a corresponding flange of the rain gutter located therebeneath.

In accordance with the preferred form of the invention, the elongated slots in the trough are generally rectangular. In the disclosed embodiment of the invention, the slots are about 5 inches in length and are spaced in series about 1 inch apart.

Means is provided for longitudinally stiffening the main body to bear additional weight. The stiffening means comprises at least one upstanding rib in the main body, and preferably comprises a series of spaced ribs extending longitudinally periodically to strengthen the generally flat main body.

It is preferred that the rain gutter protecting device according to the invention is formed of a continuous length of metal, such as aluminum, which is roll-formed into the shape described herein. However, the gutter protecting device can be formed in other manners, and may also be formed of more than one part, with the parts being appropriately joined to one another to form the shape of the invention.

BRIEF DESCRIPTION OF THE DRAWING

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
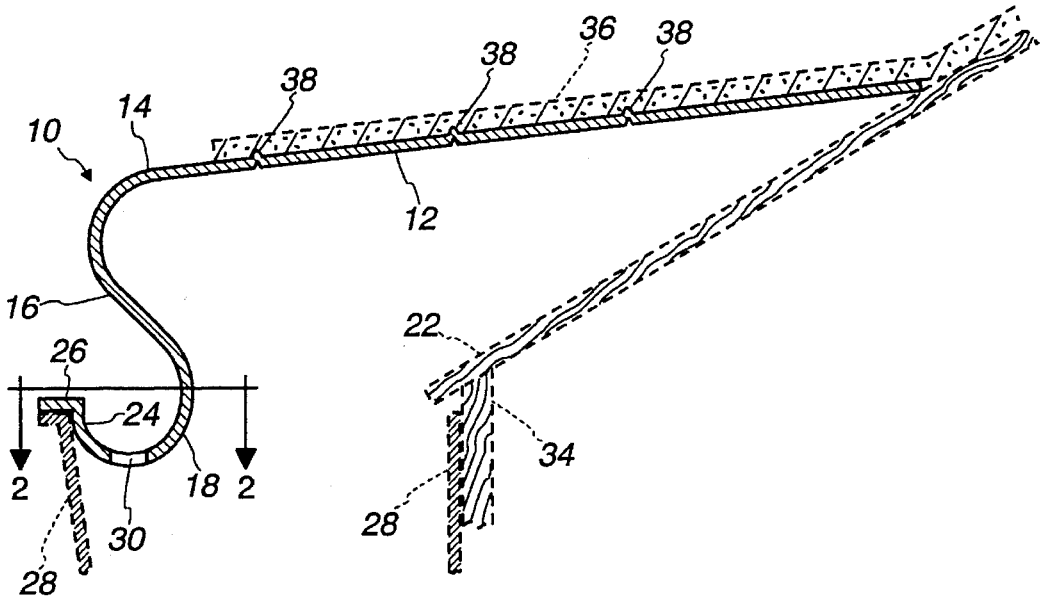
FIG. 1 is a elevational cross-section of a rain gutter protecting device according to the invention, exaggerated in thickness and shown in relation to portions of a building structure and gutter, which are shown in phantom.

A rain gutter protecting device according to the invention is shown generally at 10 in the drawing figures. The rain gutter protecting device comprises two basic portions, a main body 12 which is adapted to be affixed to a roof, and a continuous rain water deflector which extends from an edge region 14 of the main body 12.

The deflector comprises four continuous portions. A first portion 16 is curved downwardly and outwardly from the edge region 14 and then recurved inwardly beneath the main body 12. A second portion 18 extends from the first portion 16 and is curved downwardly and outwardly beneath the main body 12, forming at least part of a trough 20 which extends parallel to the roof 22 and which is adapted to capture water therein. A third portion 24 extends from the second portion 18 and is curved generally upwardly from the second portion. Finally, a fourth portion 26 extends outwardly from the third portion 24, forming a continuous attachment flange which is adapted to be secured to a conventional gutter therebeneath, shown generally in phantom at 28.

Figure 2:
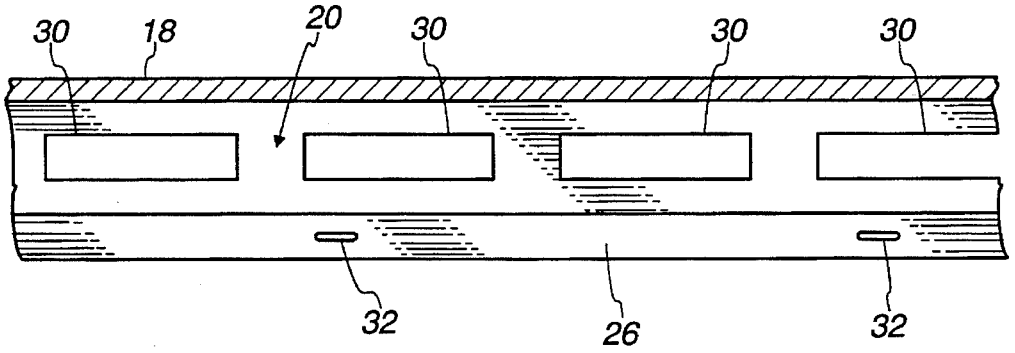
FIG. 2 is a cross-sectional illustration taken along lines 2—2 of FIG. 1, showing the trough of the rain gutter protecting device of the invention and the means of affixing the protecting device to a gutter.

As best shown in FIG. 2, a plurality of spaced elongated slots 30 are located in the trough 20 and are shaped to emit water from the trough 20 into the gutter 28 extending therebeneath. The slots 30 are preferably generally rectangular in shape, although other shapes can be employed, and in the preferred form are about 5 inches in length, ⅝ inches in width, and are spaced in series about 1 inch apart. That shaping and spacing is quite adequate to accommodate the rain water flow from a roof, while still inhibiting dirt, debris and other material from entering the slots 30. Preferably the trough 20 is about ½ inch deep, thus extending somewhat within the gutter 28 but still not forming a structure sufficient to capture and hold debris and other material therewithin.

As illustrated in FIG. 1, the second portion 18 and the third portion 24 form the trough 20, and the trough is oriented below the first portion 16 and at least partially beneath the main body 12. Again, that is so that debris is not attracted by the trough 20, yet rain water, with natural adhesion to the protecting device 10, flows over the first portion 16, down the second portion 18 into the trough 20, and is then emitted into the gutter 28.

The outwardly extending flange 26 is intended to be secured to the gutter 28. As shown in FIG. 2, the flange 26 is provided with a series of oval apertures 32 through which screws, bolts, rivets or other fasteners can be passed to secure the flange 26 to the gutter 28.

The protecting device 10 according to the invention can be applied to a gutter already affixed to a structure, or can be applied during construction of the structure. In either case, the gutter 28 is conventionally applied to the structure, such as to a facia 34 extending beneath the roof 22. The gutter protecting device 10 is then applied, with the main body 12 being secured to the roof 22, such as by being nailed thereto, with the outwardly extending flange 26 being seated directly on top of the corresponding outwardly extending flange of the gutter 28. Appropriate fasteners are then used to affix the flange 26 to the corresponding flange of the gutter 28. Roofing material, shown generally at 36, may then be applied over the main body 12 to at least partially cover the protecting device 10, providing a more aesthetic appearance to the invention. The roofing material 36 may extend as far as desired along the main body 12, up to the edge region 14.

The rain gutter protecting device 10 according to the invention is preferably formed of metal, such as aluminum, and generally has little structural strength required of it. For long expanses of the main body 12, one or more strengthening ribs 38 can be roll-formed into the main body 12 for strengthening purposes. If the metal of the protecting device 10 is sufficiently thick, however, or if it has a sufficient load bearing capacity, the ribs 38 can be omitted.

Given the nature of the rain gutter protecting device 10, its preferred formation from aluminum, and its shape, it is inherently flexible at the flange 26. Thus, even though the conventional gutter 28 may vary in width along the facia 34 of a building, the protecting device 10 according to the invention can always be properly seated along the gutter 28, forming a complete seal. Entrance to the gutter 28 is permitted only through the series of slots 30.

Various changes can be made to the invention without departing from the spirit thereof or scope of the following claims.

What is claimed is:

1. A rain gutter protecting device, comprising a. an elongated, continuous main body adapted to be affixed to a roof and to extend outwardly from the roof over a rain gutter secured along one edge of the roof, b. an elongated, continuous rain water deflector extending laterally along and from an edge region of said main body, said deflector comprising a first portion curved downwardly and outwardly from said edge region and then recurved inwardly beneath said main body, a second portion extending from said first portion and curved downwardly outwardly beneath said main body forming at least part of a trough parallel to the roof edge and adapted to capture water therein, a third portion extending from said second portion and curved upwardly from said second portion, said second and third portions completely forming said trough, said trough being oriented below said first portion and at least partially beneath said main body, and a fourth portion extending outwardly from said third portion and comprising a continuous attachment flange, c. a plurality of spaced elongated slots in said second portion and shaped to emit water from said trough into the rain gutter, said slots being generally rectangular and about 5 inches in length and spaced in series about 1 inch apart, and d. means for affixing said flange to a rain gutter, said affixing means comprising a series of spaced apertures in said flange through which fasteners may be passed and affixed to a corresponding flange of a rain gutter.

2. A rain gutter protecting device according to claim 1 including means for longitudinally stiffening said main body.

3. A rain gutter protecting device according to claim 2 in which said stiffening means comprises at least one longitudinal upstanding rib in said main body.

4. A rain gutter protecting device according to claim 1 in which said main body and said rain water deflector are unitary.

* * * * *